US010793340B2

(12) United States Patent
Murdoch

(10) Patent No.: US 10,793,340 B2
(45) Date of Patent: Oct. 6, 2020

(54) CARTRIDGE

(71) Applicant: Illinois Tool Works Inc., Glenview, IL (US)

(72) Inventor: Thomas Murdoch, Warooka (AU)

(73) Assignee: Illinois Tool Works Inc., Glenview, IL (US)

( * ) Notice: Subject to any disclaimer, the term of this patent is extended or adjusted under 35 U.S.C. 154(b) by 320 days.

(21) Appl. No.: 15/506,146

(22) PCT Filed: Aug. 29, 2015

(86) PCT No.: PCT/US2015/047613
§ 371 (c)(1),
(2) Date: Feb. 23, 2017

(87) PCT Pub. No.: WO2016/036620
PCT Pub. Date: Mar. 10, 2016

(65) Prior Publication Data

US 2017/0253411 A1 Sep. 7, 2017

(30) Foreign Application Priority Data

Sep. 1, 2014 (AU) ..... 2014903488

(51) Int. Cl.
*B65D 81/32* (2006.01)
*B65B 3/12* (2006.01)
*B65B 7/28* (2006.01)

(52) U.S. Cl.
CPC ..... *B65D 81/325* (2013.01); *B65B 3/12* (2013.01); *B65B 7/28* (2013.01); *B65D 81/3227* (2013.01)

(58) Field of Classification Search
CPC ..... B65D 81/325; B65D 81/3227; B05C 17/00553; B05C 17/00559;
(Continued)

(56) References Cited

U.S. PATENT DOCUMENTS 2,661,870 A * 12/1953 Huenergardt ..... B65D 81/3227 215/6
2,926,818 A * 3/1960 Spero ..... B65D 81/325 222/135
(Continued)

FOREIGN PATENT DOCUMENTS

EP 0 747 114 12/1996
EP 1 172 154 1/2002
(Continued)

OTHER PUBLICATIONS

International Search Report and Written Opinion for International Application No. PCT/US2015/047613 dated Nov. 23, 2015 (11 pages).
(Continued)

*Primary Examiner* — Charles Cheyney
(74) *Attorney, Agent, or Firm* — Neal, Gerber & Eisenberg LLP

(57) ABSTRACT

Various embodiments of the present disclosure provide a cartridge for dispensing two-part fluids. In one embodiment, the cartridge comprises a cartridge body having a dispensing end and defining a first fluid reservoir and a second fluid reservoir. The dispensing end defines at least one aperture fluidly connected to the first fluid reservoir. The dispensing end also defines a dispensing conduit fluidly connected to the second fluid reservoir. The cartridge further comprises a nozzle member engageable with the cartridge body to form an outlet and to fluidly connect the at least one aperture to the outlet.

16 Claims, 9 Drawing Sheets

(58) Field of Classification Search
CPC ..... B05C 17/00576; B05C 17/00583; B65B 3/12; B65B 7/28
USPC ..... 222/137, 139, 145.5, 136, 145.1
See application file for complete search history.

(56) References Cited

U.S. PATENT DOCUMENTS 3,197,066 A * 7/1965 Denzler ..... B65D 77/0493 220/920
3,813,011 A * 5/1974 Harrison ..... B65D 83/20 222/136
4,983,379 A * 1/1991 Schaeffer ..... A61K 8/042 424/52
5,033,650 A * 7/1991 Colin ..... B05C 17/00506 222/137
5,301,842 A * 4/1994 Ritter ..... B65D 81/325 220/617
5,667,102 A * 9/1997 Keller ..... B05C 17/00513 222/327
6,302,574 B1 * 10/2001 Chan ..... A61B 17/8825 222/137
6,471,098 B1 * 10/2002 Shiau ..... B05C 17/00553 222/145.1
6,681,957 B1 * 1/2004 Green ..... B05C 17/00553 222/135
7,194,847 B2 * 3/2007 Summons ..... B65B 3/14 141/10
7,207,607 B2 * 4/2007 Brugner ..... B05C 17/00516 285/328
7,306,126 B2 * 12/2007 Brugner ..... B05C 17/00506 220/506
9,901,419 B2 * 2/2018 Muller ..... A61C 9/0026
2004/0216591 A1 * 11/2004 Assadi ..... B05C 17/00513 89/1.14
2006/0151530 A1 7/2006 Horner et al.
2007/0012724 A1 * 1/2007 Feinberg ..... A61B 17/00491 222/137
2013/0015205 A1 * 1/2013 Hiemer ..... B29C 45/4407 222/137

FOREIGN PATENT DOCUMENTS

EP 1 679 126 7/2006
WO WO 95/05984 3/1995
WO WO 2013/056872 4/2013

OTHER PUBLICATIONS

Australian Examination Report No. 1 for Australian Application No. 2015312253, dated Sep. 19, 2017 (3 pages).
New Zealand Further Examination Report for New Zealand Application No. 728407, dated Dec. 12, 2017 (3 pages).

* cited by examiner

CARTRIDGE

PRIORITY CLAIM

This patent application is a national stage entry of PCT Application No. PCT/US2015/047613, which was filed on Aug. 29, 2015, which claims priority to and the benefit of Australian Patent Application No. 2014903488, which was filed on Sep. 1, 2014, the entire contents of each of which are incorporated herein by reference.

FIELD

The present disclosure relates to cartridges for dispensing fluids. More particularly, but not exclusively, the present disclosure relates to cartridges for dispensing a two-part adhesive.

BACKGROUND

To prevent leakage and air spoilage, it can be difficult to fill and assemble cartridges for dispensing fluids, particularly in a cost-effective manner. Previously, cartridges have been capped at a dispensing end and fluid introduced from a rearward end. With elongate cartridges that use a piston for dispensing the fluids, inserting the piston can be difficult as ventilation is required to evacuate air from between the piston and the fluid. One solution is to provide a piston having a valve, which adds complexity and cost to the cartridge. Another solution is to provide a narrow member along a wall of the cartridge and slide the piston along the narrow member to create a ventilation space. Removal of the narrow member then seals the cartridge; however, damage to the piston and seals commonly occurs.

Sealing of cartridges used for two-part fluids such as adhesives having a resin and catalyst, for example a masonry anchor cement, can be difficult as highly fluid components of resin and/or catalyst can separate from the adhesive and find a path through the smallest gap between a seal and cartridge wall. As such, it is important that a seal on the piston is optimally placed and not compromised in any way during assembly.

Generally, it is desirable to provide a cartridge that can be quickly and easily filled and that does not leak. It is also desirable to provide a cartridge that is refillable and recyclable.

Examples of the present disclosure seek to solve, or at least ameliorate, one or more disadvantages of previous cartridges.

SUMMARY

According to one aspect of the present disclosure, there is provided a cartridge for dispensing two-part fluids, comprising: a cartridge body having a first fluid reservoir and at least one aperture in a dispensing end of the cartridge body through which fluid can flow for dispensing, and a second fluid reservoir with a dispensing conduit at the dispensing end through which fluid can flow for dispensing; and a nozzle member configured for engagement with the dispensing end and forming a fluid path from the at least one aperture to an outlet disposed in close proximity to an outlet of the dispensing conduit.

According to one embodiment of the present disclosure, the cartridge further comprises a cap configured to close the outlet and the dispensing conduit. In various embodiments, the cap has an annular portion for sealing the outlet from the first fluid reservoir and a circular portion for sealing the dispensing conduit from the second fluid reservoir, the annular and circular portions being concentric.

The second fluid reservoir is in certain embodiments disposed generally within the first reservoir. The reservoirs are concentric in various embodiments.

In one embodiment, the nozzle member forms a chamber or an outer conduit around the dispensing conduit, the conduits terminating in close proximity and forming a dispensing nozzle.

In various embodiments, the nozzle member is removable to allow filling of the reservoirs from the dispensing end. The nozzle member and cartridge body may be configured for threaded engagement. The nozzle member can have a plurality of lobes formed on another surface thereof, the lobes configured for engagement to rotate the nozzle member to fix it to the cartridge body.

According to another aspect of the present disclosure, there is provided a method of filling a cartridge for dispensing fluid, the cartridge having a cartridge body having a first fluid reservoir with at least one aperture in a dispensing end of the cartridge body for dispensing the fluid and a second fluid reservoir with a dispensing conduit at the dispensing end, including the steps of: installing a piston in each reservoir near the dispensing end of the cartridge body; filling the first fluid reservoir with fluid through the at least one aperture and filling the second fluid reservoir with fluid through the dispensing conduit; bringing a nozzle member into engagement with the dispensing end of the cartridge body, the nozzle member forming a fluid path from the at least one aperture to an outlet disposed in close proximity to an outlet of the dispensing conduit; and installing a cap over the outlets to close the cartridge.

BRIEF DESCRIPTION OF THE DRAWINGS

Certain embodiments of the present disclosure will be further described, by way of nonlimiting example only, with reference to the accompanying drawings.

DETAILED DESCRIPTION

Figure 1:
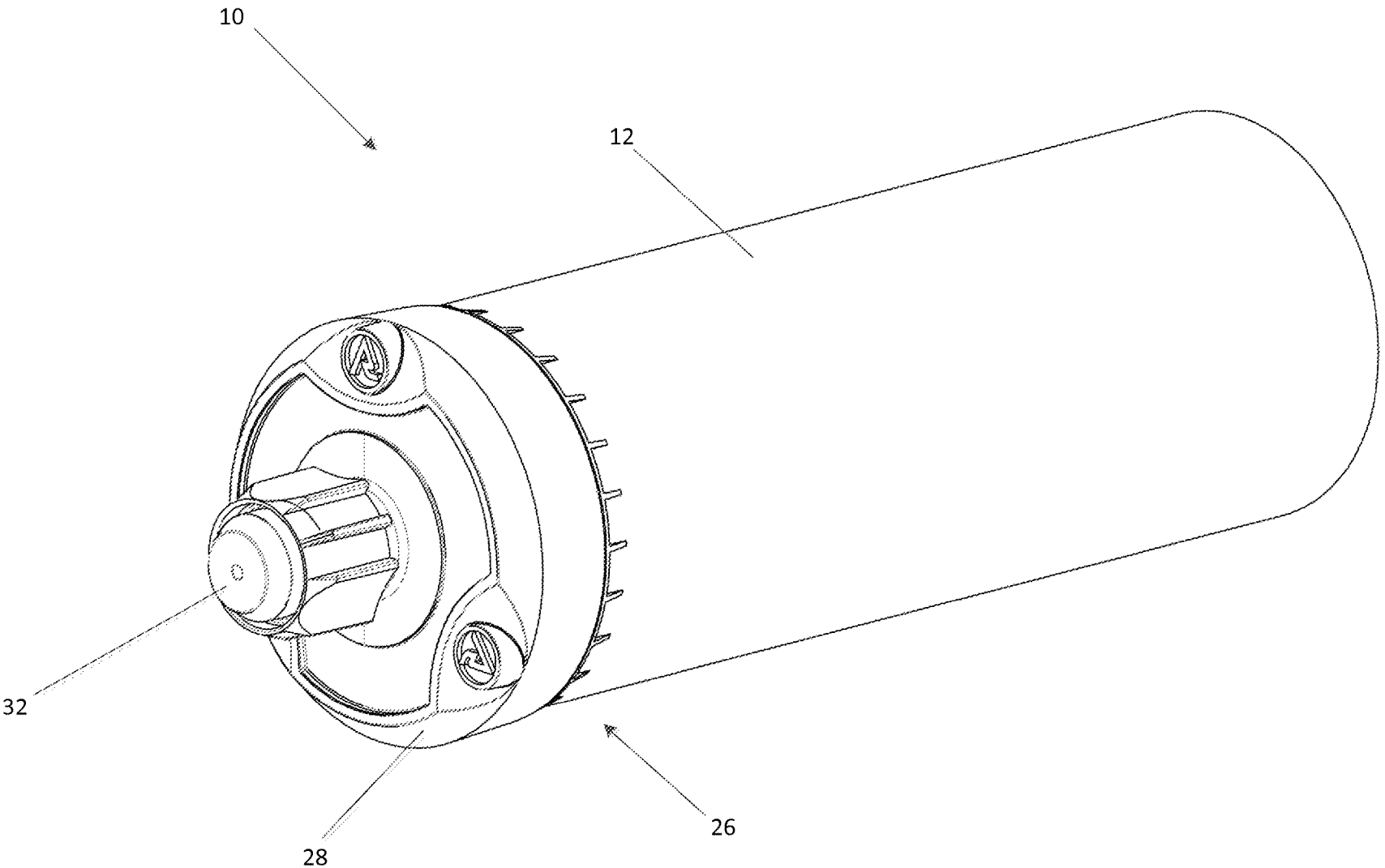
FIG. 1 is a perspective view of a cartridge of one embodiment of the present disclosure.
Figure 2:
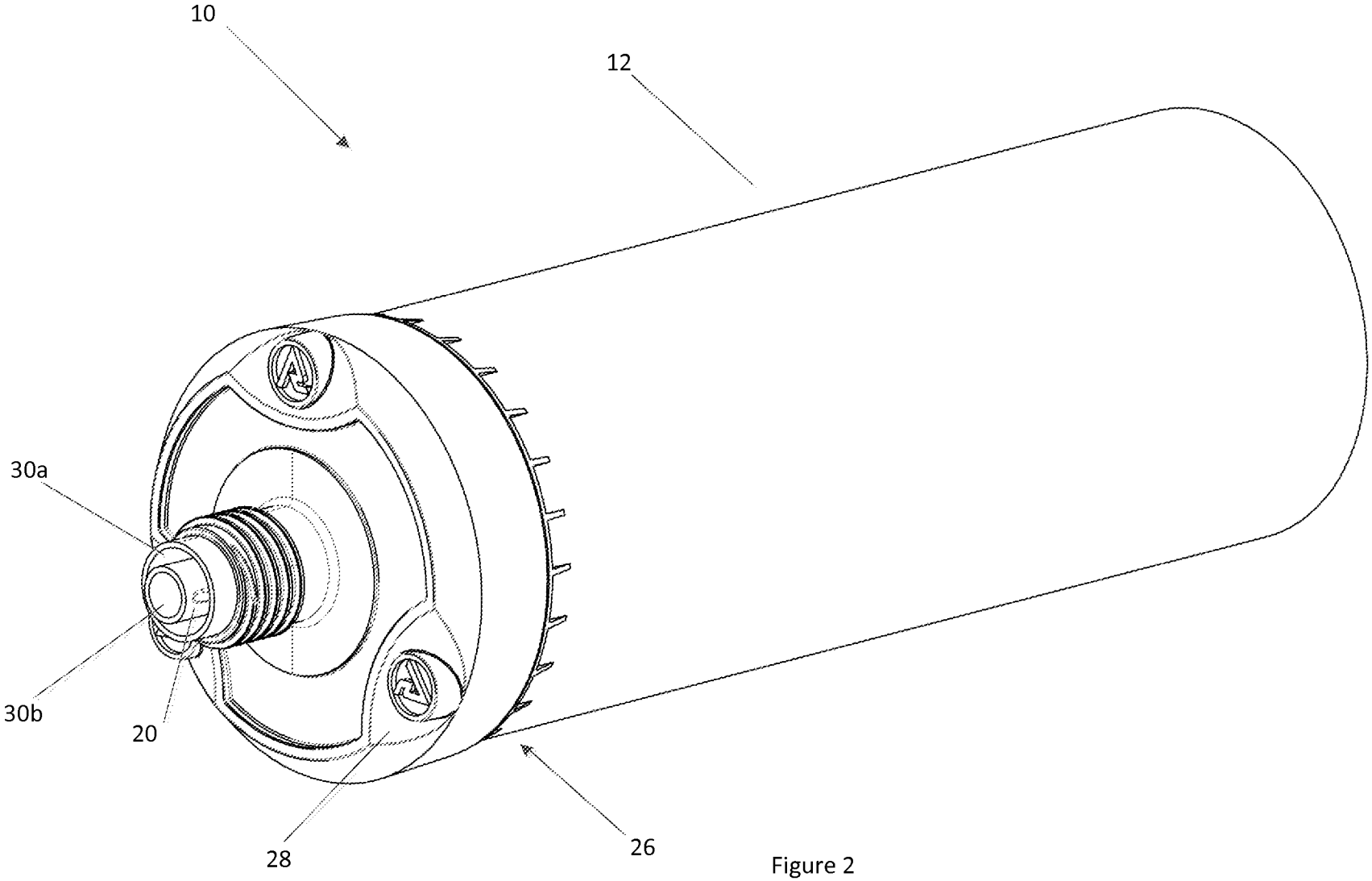
FIG. 2 is a perspective view of the cartridge with an end cap removed.
Figure 3:
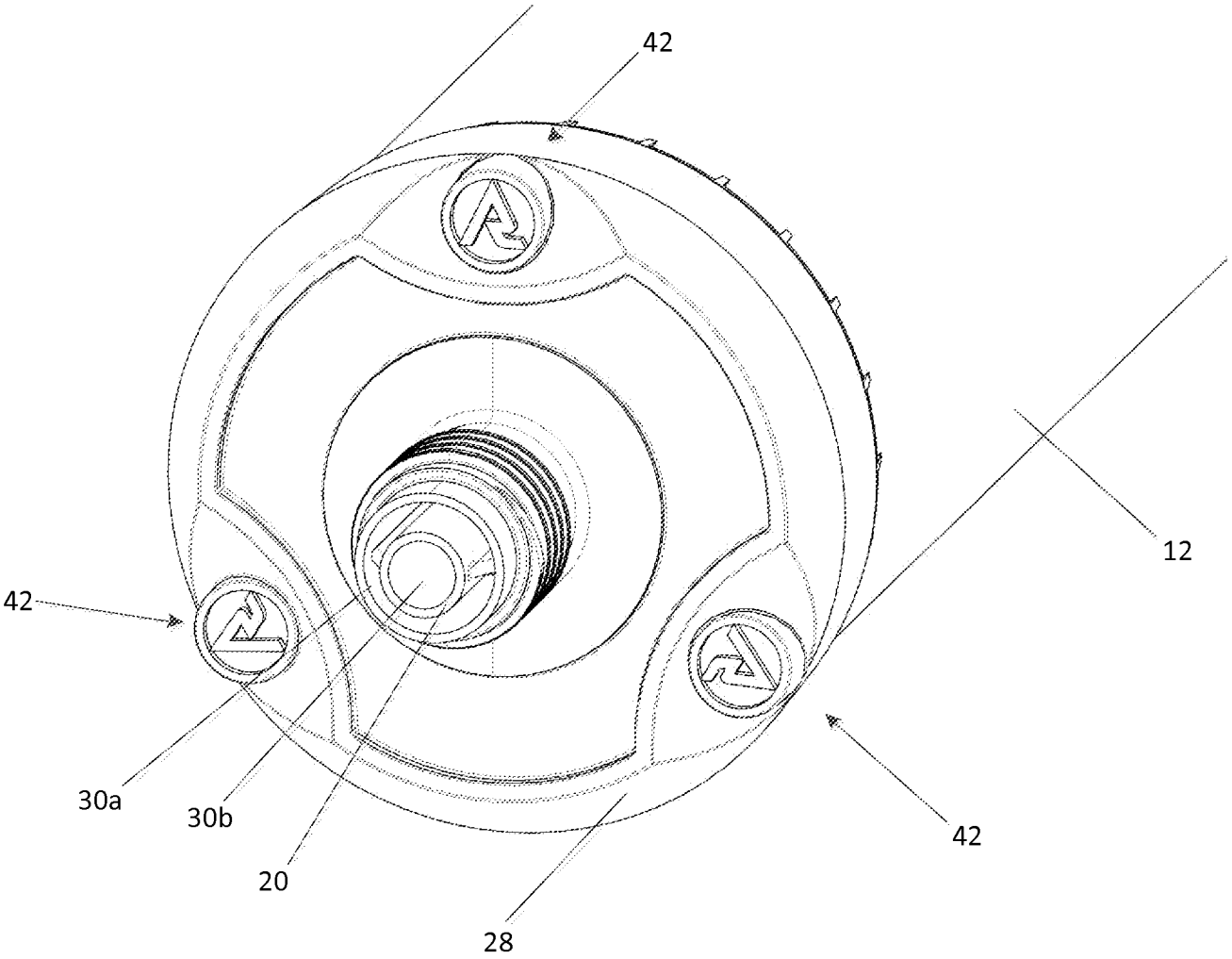
FIG. 3 is a close perspective view of a dispensing end of the cartridge.

A cartridge 10 according to one embodiment of the present disclosure is shown in FIG. 1. The cartridge 10 is configured for dispensing two-part fluids, which is the described embodiment is a two-part resin and catalyst adhesive.

Figure 4:
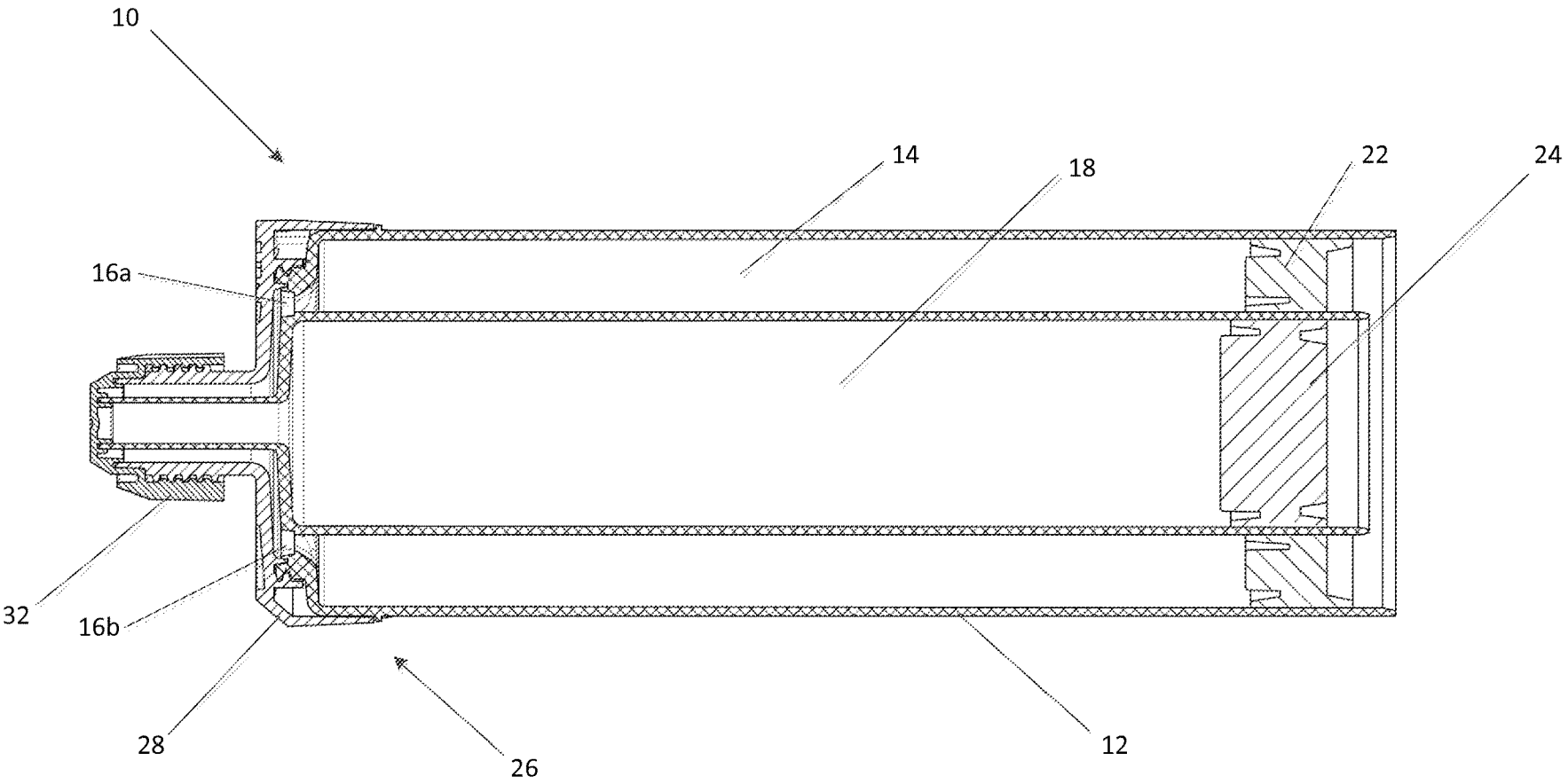
FIG. 4 is a side sectional view of the cartridge.

The cartridge 10 includes a cartridge body 12 having first and second reservoirs that in the described embodiment are referred to as a primary fluid reservoir 14 (refer FIG. 4) and a secondary fluid reservoir 18. Although the primary fluid reservoir 14 is shown as being of a larger volume than the secondary fluid reservoir 18, it will be appreciated that the volumetric ratio between the reservoirs will vary depending on the product being dispensed and it may be that the reservoirs are of equal volume or that the primary fluid reservoir 14 has a larger volume than the secondary reservoir 18.

The primary fluid reservoir 14 has at least one aperture formed in a dispensing end 26 of the cartridge body 12 and through which the fluid can flow for dispensing. In the illustrated embodiment, two apertures 16*a* and 16*b* are provided, though it will be appreciated that a single aperture may be sufficient, as would be 3, 4, or more apertures, depending on the nature of the fluid to be dispensed and the required dispensing performance. In use, fluid flows from the primary fluid reservoir 14, through apertures 16*a* and 16*b* under the action of a piston 22, which is urged toward the dispensing end 26 of the cartridge 10.

The secondary fluid reservoir 18 has a dispensing conduit 20 at the dispensing end 26 of the cartridge body 12 and extending therefrom. The conduit 20 is shown as being integral with the secondary fluid reservoir 18, though may be separate from the cartridge body 12 and simply fixed, either removably or permanently, to the cartridge body 12. In use, fluid flows from the secondary fluid reservoir 18 through dispensing conduit 20 under the action of piston 24, which is urged toward the dispensing end 26 of the cartridge.

In the illustrated embodiment, the secondary fluid reservoir 18 is disposed within the primary fluid reservoir 14 in a concentric arrangement, though it will be appreciated that the fluid reservoirs may be otherwise arranged. In this regard, the reservoirs may or may not be concentric. Also, they may or may not be coaxial and share a longitudinal axis. Also, the secondary fluid reservoir 18 may be only partly or generally within the primary fluid reservoir 14. Furthermore, the secondary fluid reservoir 18 may be disposed outside of the primary fluid reservoir 14, in an adjacent or side-by-side arrangement for example.

The illustrated cartridge body 12 is integrally formed with the cartridge body 12 defining the primary and secondary fluid reservoirs 14 and 18. The cartridge body 12 is in certain embodiments formed of polypropylene, in certain embodiments a glass-filled polypropylene having 20% glass fill, and formed using conventional injection molding techniques.

The cartridge 10 also includes a nozzle member 28 configured for engagement with the dispensing end 26 of the cartridge body 12. The nozzle member 28 is in the form of a lid and forms a fluid path from the apertures 16*a* and 16*b* to an outlet 30*a*. The outlet 30*a* is disposed in close proximity to an outlet 30*b* of the dispensing conduit 20. In the illustrated embodiment, the outlets 30*a* and 30*b* are concentric and the nozzle member 28 forms a chamber or an outer conduit around the dispensing conduit 20, though it will be appreciated that other arrangements are also possible, provided that the outlets terminate in close proximity with each other so as to dispense the fluids from the primary and secondary fluid reservoirs 14 and 18 while bringing the fluids into contact with each other so as to promote activation of the resin by the catalyst. The nozzle member 28 may promote mixing, though mixing may also occur outside of the nozzle member, in a hole for example. Although shown as being concentric, the outlets 30*a* and 30*b* may be in an adjacent or side by side arrangement, for example.

The nozzle member 28 may also be formed of polypropylene, such as glass filled polypropylene having 20% glass fill for example, and formed using conventional injection molding techniques.

Figure 9:
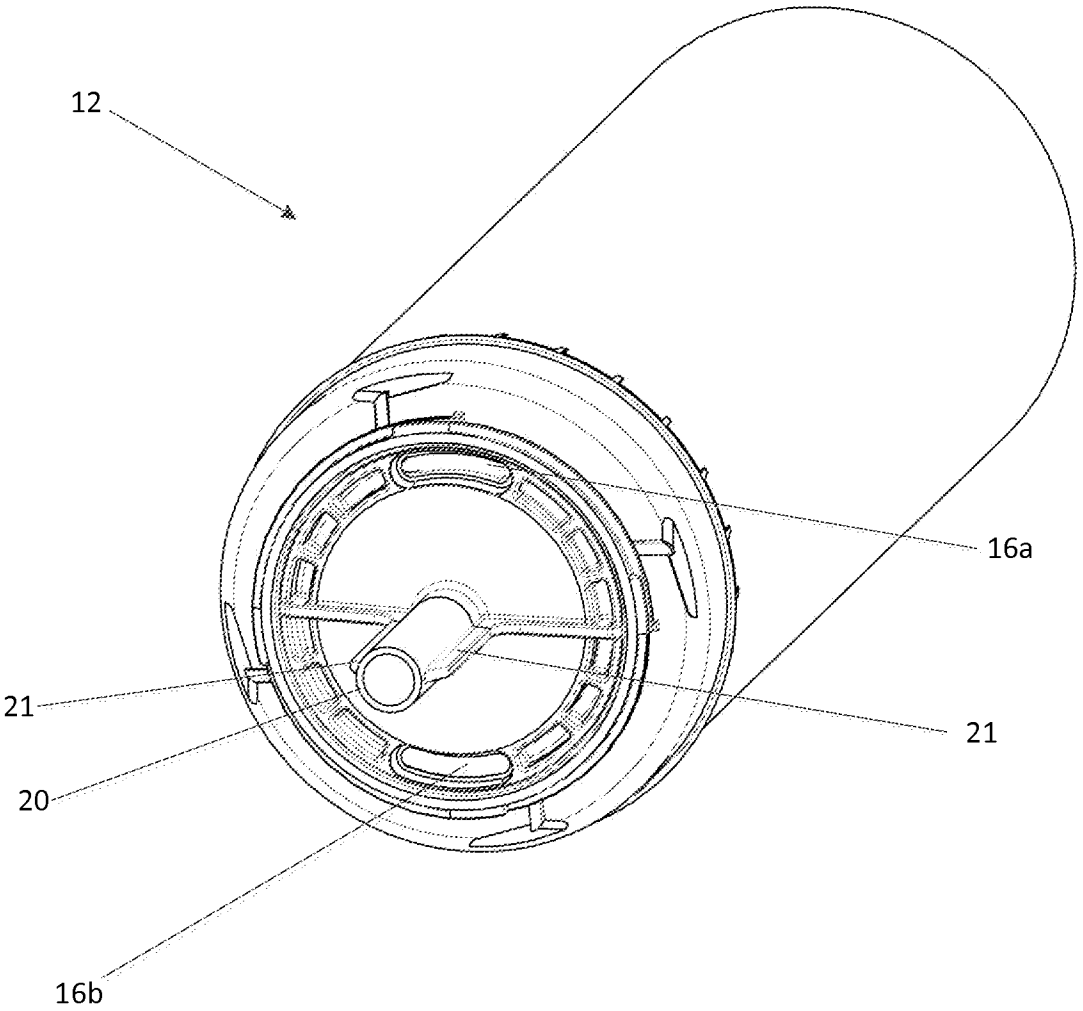
FIG. 9 is a perspective view of a cartridge body.

As illustrated in FIG. 9, the dispensing conduit 20 is formed with ribs 21 that assist in locating the nozzle member 28 during assembly and act to maintain separation between the conduit 20 and the nozzle member 28.

In use, a further nozzle (not shown), which may be a conventional nozzle of elongate form, may be fitted to the nozzle member 28. The nozzle provides means for dispensing fluids in narrow openings and may assist in mixing of the fluids.

Figure 5:
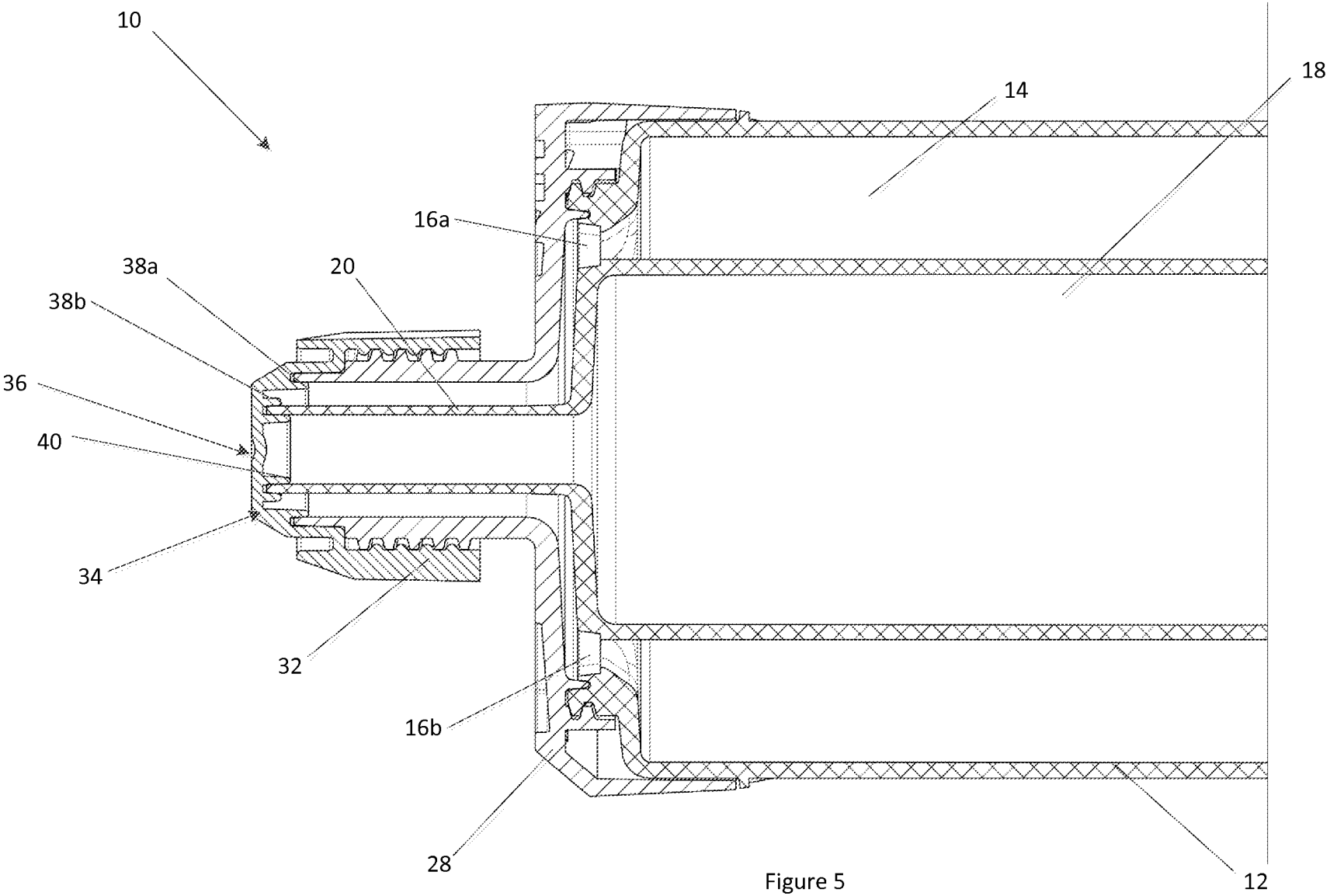
FIG. 5 is a close side sectional view of a dispensing end of the cartridge.
Figure 6:
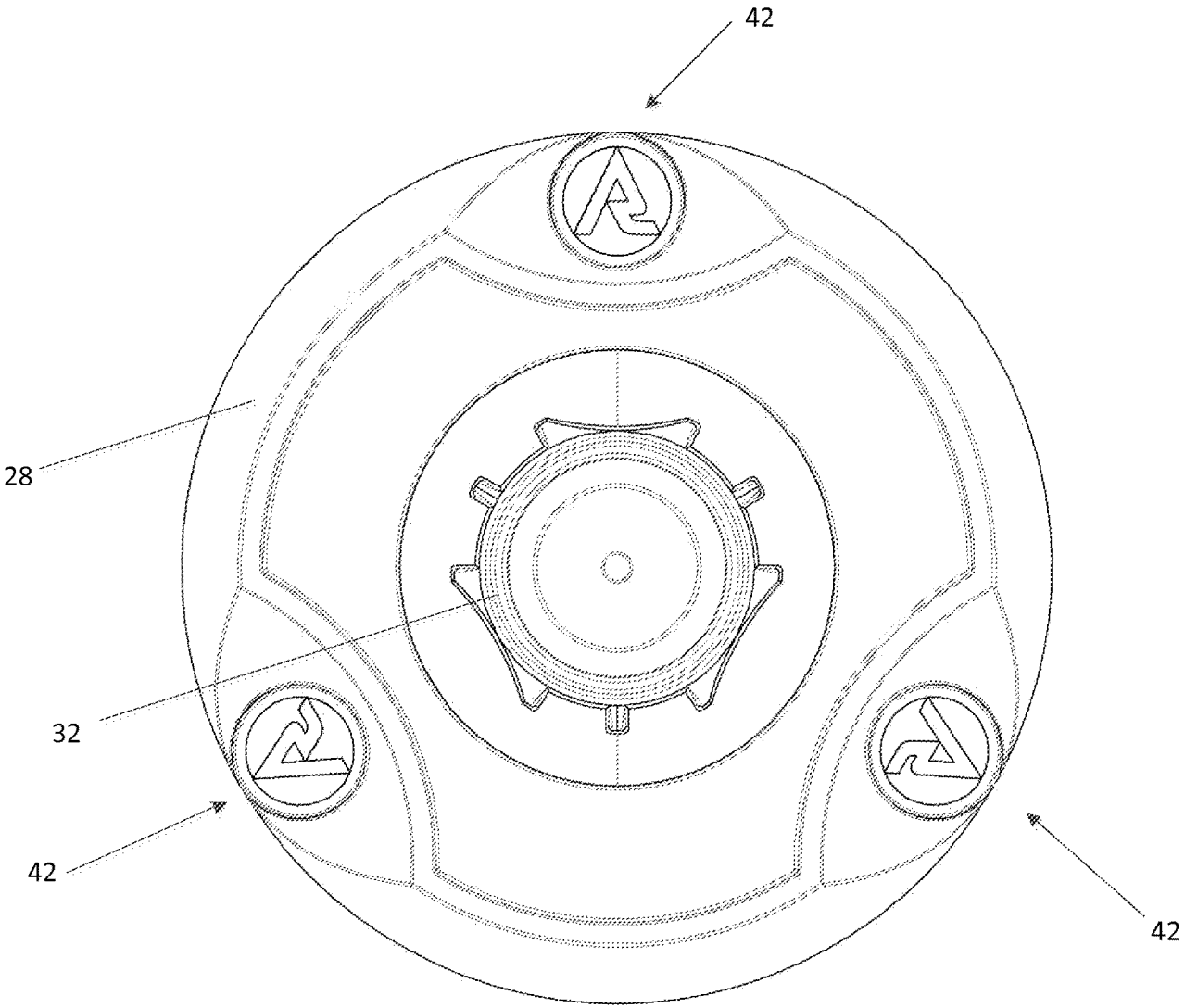
FIG. 6 is an end view of the cartridge.
Figure 7:
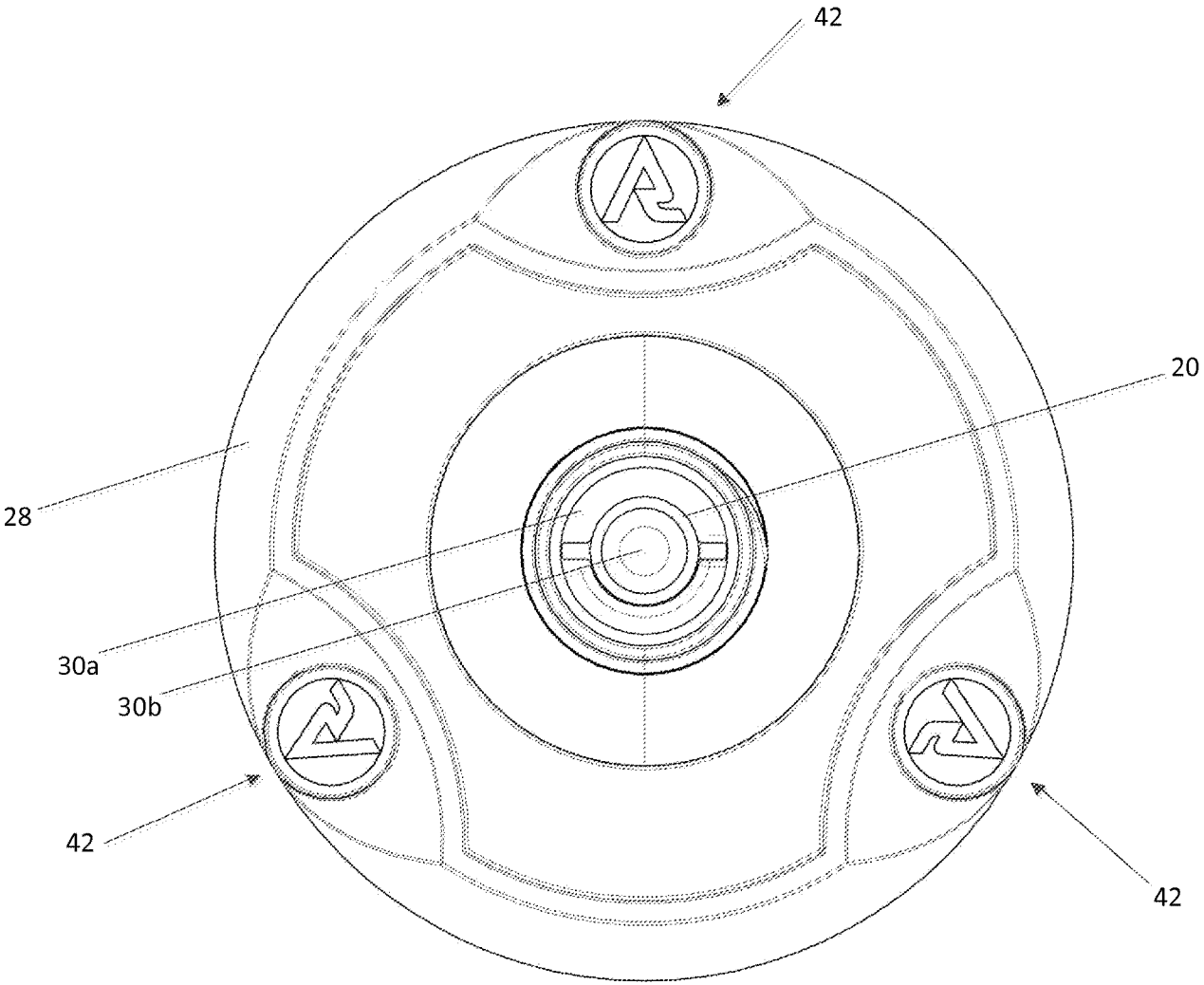
FIG. 7 is an end view of the cartridge with an end cap removed.
Figure 8:
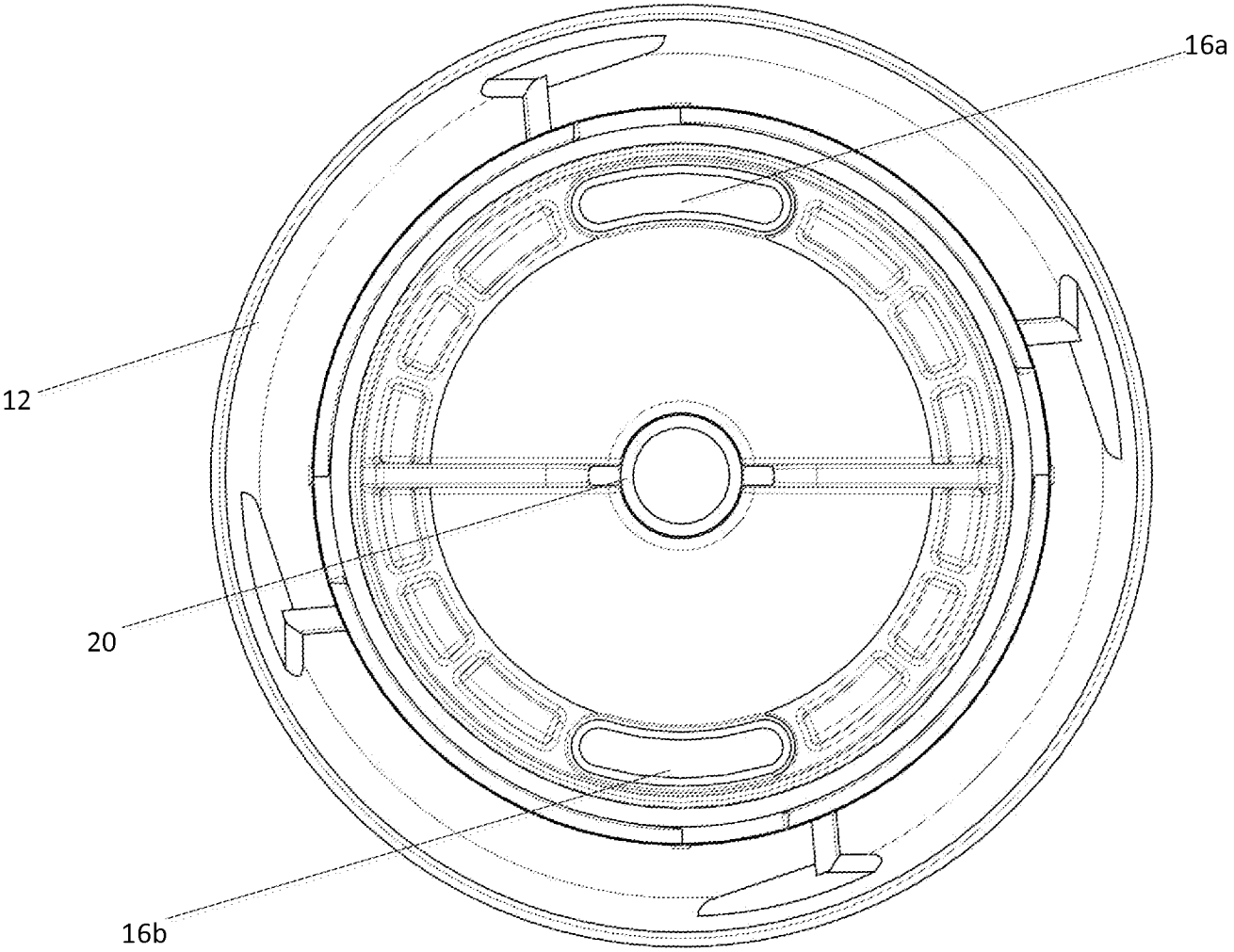
FIG. 8 is an end view of a cartridge body.

As illustrated in FIG. 5, the nozzle member 28 and the cartridge body 12 cooperate to transfer fluid from the primary and secondary fluid reservoirs 14 and 18 to outlets 30*a* and 30*b*. In some embodiments, the nozzle member 28 and the cartridge body 12 together define fluid paths. In other embodiments, the nozzle member 28 alone may define the fluid paths with the nozzle member 28 forming a dispensing nozzle.

It will be appreciated that the nozzle member 28 may be of a modular design and interchangeable with alternative nozzle members taking different forms depending on the requirements of the application. For example, the nozzle member may incorporate additional functionality or technical features, such as gas-operated means for assisting fluid flow. Also, the nozzle member may incorporate a valve or mixing means. Advantageously, the cartridge 10 may have other applications and be used for dispensing different fluids.

The nozzle member 28 and cartridge body 12 may be configured for threaded engagement so as to securely affix the parts together. To facilitate installation, the nozzle member 28 can have a plurality of lobes 42 formed on another surface thereof. The lobes 42 are configured for engagement to rotate the nozzle member 28 to fix it to the cartridge body 12. Although the nozzle member 28 is shown as having three lobes 42, it will be appreciated that arrangements having 2, 4, or more lobes may also be provided. By providing the nozzle member 28 and cartridge body 12 in threaded engagement, the nozzle member 28 may be removable to allow refilling. In other embodiments, the nozzle member 28 may be permanently fixed or bonded to the cartridge body 12.

The cartridge 10 further comprises a cap 32 configured to close the outlets 30*a* and 30*b*. In the illustrated embodiment, the cap 32 is in threaded engagement with the nozzle member 28, though it will be appreciated that it may be affixed by other means, such as a tight or tapered fit using friction for retention, for example. To close the outlets 30*a* and 30*b* the cap has respective portions for sealing each of outlets 30*a* and 30*b*. In this regard, the cap 32 has an annular portion 34 for sealing the outlet 30*a* from the primary fluid reservoir 14 and a circular portion 36 for sealing the outlet 30*b* from the secondary fluid reservoir 18. Owing to the nature of the outlets 30*a* and 30*b*, the annular and circular portions 34 and 36 are concentric, though in other embodiments they will be otherwise arranged to be complimentary with the outlets 30*a* and 30*b*.

To prevent or at least reduce leakage from outlets 30*a* and 30*b*, seals are provided within the cap. In this regard, the cap 32 includes seals 38*a* and 38*b* for sealing the outlet 30*a*. The cap also includes seal 40 for sealing outlet 30*b*. The seals 38*a* and 38*b* and 40 are in various embodiments formed with a narrowed wall thickness so as to be flexible yet retain sufficient rigidity to maintain a seal, and dimensioned so as to be tightly fitting or in a slight interference fit with the conduit 20 and nozzle member 28.

As described above, the nozzle member 28 is configured for engagement with a dispensing end 26 of the cartridge body 12. By providing a nozzle member 28 as a separate part, the cartridge 10, in particular the reservoirs 14 and 18, may be filled from the dispensing end 26. Furthermore, by providing the nozzle member 28 as a separate part, manufacturing is simplified and a favorable tool draw is obtained that allows prominent markings to be formed on an outer surface. This can improve aesthetics and allow prominent branding to be displayed.

Filling of the cartridge 10 is performed by installing pistons 22 and 24 into the cartridge body 12. The pistons 22 and 24 are advanced toward the dispensing end 26. By filling the primary and secondary fluid reservoirs 14 and 18 under pressure, the pistons 22 and 24 are pushed into an in use position away from the dispensing end. Advantageously, as the pistons pass over a clean surface, leakage may be avoided. The primary fluid reservoir 14 is filled with a resin, in certain embodiments an epoxy resin, through apertures 16*a* and 16*b* using an apparatus having nozzles which are correspondingly shaped with the apertures 16*a* and 16*b* so as to prevent leakage. The secondary fluid reservoir 18 is filled with a catalyst or hardener through conduit 20. A filling machine (not shown) may be provided for simultaneous filling. The filling machine may contain a supply of resin stored separately from a catalyst and have respective nozzles for engagement with the apertures 16*a* and 16*b* and conduit 20.

Once the respective primary and secondary reservoirs 14 and 18 have been filled with resin and catalyst, the nozzle member 28 is installed to form a fluid path from the aperture 16*a* and 16*b* to outlet 30*a*, thereby providing a dispensing nozzle for the fluids. Once filling is complete and the nozzle member 28 installed, the pistons may be advanced to remove air from the cartridge. Finally, cap 32 is installed over the outlets 30*a* and 30*b* to close the cartridge.

Compared with previous filling methods, the described cartridge allows conventional pistons to be used yet provides an improved seal that has the potential to minimize leakage.

The embodiments have been described by way of example only and modifications are possible within the scope of the present disclosure disclosed.

The invention claimed is:

1. A cartridge for dispensing two-part fluids, the cartridge comprising:

a cartridge body having a dispensing end and defining:

a first fluid reservoir defining a first inner surface;

a second fluid reservoir positioned at least partially within the first fluid reservoir and spaced apart from the first inner surface at a first radial distance, the dispensing end defining a plurality of apertures spaced apart from each other, each of the plurality of apertures being fluidly connected to the first fluid reservoir and having a width of a second radial distance, the second radial distance being less than the first radial distance;

a shoulder integrally connecting a dispensing conduit to the second fluid reservoir at the dispensing end;

wherein the plurality of apertures are disposed on the shoulder; and a nozzle member engageable with the cartridge body to form an outlet and to fluidly connect the plurality of apertures to the outlet, wherein a first portion of the cartridge body is connectable with the nozzle member and spaced apart from the first inner surface at a third radial distance, the third radial distance being greater than the second radial distance and less than the first radial distance± wherein the shoulder extends in a plane that is coplanar with the first portion of the cartridge body and the plurality of apertures.

2. The cartridge of claim 1, wherein the dispensing conduit comprises a dispensing conduit outlet.

3. The cartridge of claim 2, further comprising a cap attachable to the nozzle member to close the outlet and the dispensing conduit outlet.

4. The cartridge of claim 3, wherein the cap defines a second inner surface and comprises:

an annular portion protruding from the second inner surface and configured to seal the outlet; and a circular portion separated from the annular portion, the circular portion protruding from the second inner surface and configured to seal the dispensing conduit outlet, the annular and circular portions being concentric.

5. The cartridge of claim 1, wherein the second fluid reservoir is positioned generally within the first fluid reservoir.

6. The cartridge of claim 5, wherein the first and second fluid reservoirs are concentric.

7. The cartridge of claim 1, wherein the nozzle member is engageable with the dispensing end to form an outer conduit around the dispensing conduit.

8. The cartridge of claim 1, wherein the nozzle member is threadably engageable with the cartridge body.

9. The cartridge of claim 1, wherein the nozzle member comprises an outer surface and multiple lobes formed on the outer surface.

10. The cartridge of claim 1, wherein the outlet and a dispensing conduit outlet of the dispensing conduit are concentric.

11. The cartridge of claim 10, wherein the outlet and the dispensing conduit outlet are in close proximity.

12. A cartridge for dispensing two-part fluids, the cartridge comprising:

a cartridge body including a dispensing end defining:

a plurality of apertures spaced apart from each other;

a dispensing conduit;

a first fluid reservoir from which first fluid can flow to each of the plurality of apertures for dispensing, the first fluid reservoir defining a first inner surface;

a second fluid reservoir from which second fluid can flow to the dispensing conduit for dispensing, the second fluid reservoir positioned at least partially within the first fluid reservoir and spaced apart from the first inner surface at a first radial distance, each of the plurality of apertures having a width of a second radial distance; and a shoulder integrally connecting the dispensing conduit to the second fluid reservoir at the dispensing end;

wherein the plurality of apertures are disposed on the shoulder; and a nozzle member engageable with the dispensing end of the cartridge body to form an outlet and to form a fluid path from each of the plurality of apertures to the outlet, wherein the outlet is disposed in close proximity to a dispensing conduit outlet of the dispensing conduit, wherein a first portion of the cartridge body is connectable with the nozzle member and spaced apart from the first inner surface at a third radial distance, the third radial distance being greater than the second radial distance and less than the first radial distance, wherein the shoulder extends in a plane that is coplanar with the first portion of the cartridge body and the plurality of apertures.

13. The cartridge of claim 12, further comprising a cap attachable to the nozzle member to close the outlet and the dispensing conduit outlet.

14. The cartridge of claim 13, wherein the cap defines a second inner surface and comprises:

an annular portion protruding from the second inner surface and configured to seal the outlet; and a circular portion separated from the annular portion, the circuit portion protruding from the second inner surface and configured to seal the dispensing conduit outlet, the annular and circular portions being concentric.

15. The cartridge of claim 14, wherein the first and second fluid reservoirs are concentric.

16. The cartridge of claim 11, wherein the outlet and the dispensing conduit outlet are concentric.

* * * * *